US006235352B1

(12) United States Patent
Leverant et al.

(10) Patent No.: US 6,235,352 B1
(45) Date of Patent: May 22, 2001

(54) METHOD OF REPAIRING A THERMAL BARRIER COATING

(75) Inventors: Gerald R. Leverant, San Antonio, TX (US); Stuart T. Schwab, Albuquerque, NM (US); Partha P. Paul; Narayana S. Cheruvu, both of San Antonio, TX (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 0 days.

(21) Appl. No.: 09/450,859

(22) Filed: Nov. 29, 1999

(51) Int. Cl.[7] ..... C23C 4/06; C23C 4/10; B05D 1/02; B05D 3/02; B05D 7/14; B05D 7/24

(52) U.S. Cl. ..... 427/454; 427/567; 427/140; 427/142; 427/226; 427/456

(58) Field of Search ..... 427/140, 142, 427/226, 566, 567, 456, 453

(56) References Cited

U.S. PATENT DOCUMENTS

| | | | | |
|---|---|---|---|---|
| 4,784,794 | | 11/1988 | Kato | 252/313.1 |
| 4,861,618 | | 8/1989 | Vine et al. | 427/34 |
| 5,264,244 | * | 11/1993 | Edwards, III | 427/226 |
| 5,266,358 | * | 11/1993 | Uemura | 427/226 |
| 5,279,904 | * | 1/1994 | Grandin de l'Eprevier | 427/226 |
| 5,292,553 | * | 3/1994 | Leture et al. | 427/226 |
| 5,378,665 | | 1/1995 | Chen et al. | 501/95 |
| 5,384,200 | | 1/1995 | Giles et al. | 428/552 |
| 5,522,371 | | 6/1996 | Kawamura | 123/668 |
| 5,723,078 | | 3/1998 | Nagaraj et al. | 264/36 |
| 5,854,154 | * | 12/1998 | Radford et al. | 427/226 |
| 5,905,336 | * | 5/1999 | Van Hal et al. | 427/226 |
| 5,948,482 | * | 9/1999 | Brinker et al. | 427/226 |
| 5,972,424 | * | 10/1999 | Draghi et al. | 427/142 |
| 5,980,983 | * | 11/1999 | Gordon | 427/226 |
| 6,010,746 | * | 1/2000 | Descoteaux et al. | 427/142 |
| 6,036,995 | * | 3/2000 | Kircher et al. | 427/142 |
| 6,042,879 | * | 3/2000 | Draghi et al. | 427/142 |
| 6,042,880 | * | 3/2000 | Rigney et al. | 427/142 |
| 6,045,863 | * | 4/2000 | Olson et al. | 427/142 |

* cited by examiner

*Primary Examiner*—Marianne Padgett
(74) *Attorney, Agent, or Firm*—Flehr Hohbach Test Albritton & Herbert LLP

(57) ABSTRACT

A method of repairing a damaged area of a thermal barrier coating on a component which is subjected to a hostile thermal environment, which comprises cleaning the damaged area, applying a partially stabilized zirconium sol-gel to the area, and pyrolizing the sol-gel to form a TBC repair layer.

16 Claims, 4 Drawing Sheets

METHOD OF REPAIRING A THERMAL BARRIER COATING

BRIEF DESCRIPTION OF THE INVENTION

The present invention relates to the repair of stabilized zirconia thermal barrier coatings that have suffered localized spallation in the hostile thermal environment to which the coating has been exposed.

BACKGROUND OF THE INVENTION

Higher operating temperatures are sought to increase the efficiency of internal combustion engines and gas turbine engines. To this end, the surfaces of the engine components subjected to the high temperatures have been provided with thermal barrier coatings to increase their durability under the high temperature operating conditions, which may include cyclic temperature and compression loads.

The thermal barrier coatings must have a low thermal conductivity and adhere to the alloy material of the component. Generally, the surface of the component is provided with a thin metallic bond layer to protect the alloy metal component from the corrosive environment to which it is subjected.

Typical metallic bond layers or coatings are an oxidation resistant alloy such as MCr-AlY where M is iron, cobalt and/or nickel. The metallic layer may, for example, be applied by plasma spray vapor deposition. After the metallic protective bond layer has been applied, a thermal barrier ceramic layer is applied. The thermal barrier or coating layer can be applied by plasma spraying an yttrium partially stabilized zirconium layer onto the surface of the metallic bond layer.

Under the severe environmental conditions in which the engine components operate, spallation may occur in localized regions of the thermal barrier coating during engine operation. The coating has in the past been repaired by completely removing the thermal barrier coating from the component, repairing the metallic bond layer, and then recoating the component.

U.S. Pat. No. 5,723,078 describes a method for repairing a thermal barrier coating in which the damaged area is cleaned to expose the metallic bond coating and then a ceramic vapor layer is applied by a plasma spray technique. This prior art technique requires special equipment for applying the coating and is not easily adaptable to field repair of the components.

OBJECTS AND SUMMARY OF THE INVENTION

It is an object of the present invention to provide a method for field repair of a thermal barrier coating on a component subjected to a hostile thermal environment.

It is another object of the present invention to provide a method for field repair of a thermal barrier coating on a component which does not require the removal of the component.

According to the invention, the damaged area of a component having a metallic bond layer with a thermal barrier coating is cleaned to expose the bond layer and then an yttrium stabilized zirconia sol-gel is applied to the damaged area and fired.

BRIEF DESCRIPTION OF THE DRAWINGS

The foregoing and other objects of the invention will be more clearly understood from the following description when read in conjunction with the accompanying drawings in which.

DESCRIPTION OF PREFERRED EMBODIMENTS

Figure 1:
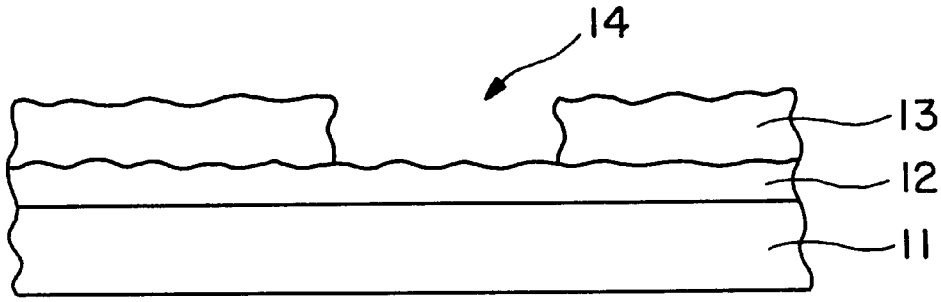
FIG. 1 is a cross-sectional representation of a portion of a component having a damaged thermal barrier coating.

Referring to FIG. 1, a cross section of a portion of a component 11 is shown with a suitable metallic bond layer 12 and a thermal barrier coating 13. The area 14 indicates damage or spallation of the thermal barrier coating, which typically is from 75 to about 300 micrometers in thickness. Typically, the damage only extends partially through the thermal barrier coating; however, the present method of repair also could be used to repair damage which extended completely through the thermal barrier coating to the bond-coat.

In accordance with the present invention, the damaged area is cleaned to remove any oxides or fragments of the ceramic thermal barrier coating to expose the metallic bond layer 12. The damaged area 14 is repaired by applying a sol-gel of partially stabilized zirconia (PSZ). After the sol-gel is applied to the damaged area and the solvent allowed to evaporate leaving the PSZ precursor. This process can be repeated until a precursor of suitable thickness is achieved. The precursor is then fired in air at, for example, 900° C. to form the thermal barrier coating. For a more dense coating the process can be repeated.

For example, the PSZ material can be prepared by combining alkoxides of zirconium and yttrium in ethanol or isopropanol (Zr-propoxide in propanol and Y-methoxyethoxide in ethoxymethanol, plus ethanol, or by combining Zr-propoxide in propanol and Y-methoxyethoxide in ethoxymethanol, plus ethanol). The gels are prepared by adding a 1:1 mixture of glacial acetic acid and deionized water to the PSZ SOL. The gelation time is manipulated by controlling the amount of added water. The sol-gels of the PSZ repair materials so made are applied to the damaged areas, then dried and fired to obtain the TBC. The process of the present invention was carried out on twelve specimens. The specimens comprised INCONEL 718 and GTD-111 alloys. The specimens were sent to Chromalloy Heavy Industries Turbines (HIT), Dallas Tex.; Sermatech International which has U.S. corporation offices at 15 South Limerick Road, Limerick, Pa. and Howmet International whose corporate offices are in Greenwich, Conn. where metallic bond layers and stabilized zirconia (PZT) were applied b methods. Table 1 provides details of the metallic bond layers and PSZ coating process of the specimens received from each vendor.

TABLE 1

| Vendor | No. of Specimens Examined | Material/Bond Coat-Coating Process/TBC Process |
|---|---|---|
| HIT | 3 | IN-718/NiCrAlY-APS/APS |
| HIT | 3 | IN-718/NiCrAlY-APS/APS |
| Sermatech | 3 | IN-718/NiCoCrAlY-APS/APS |
| Howmet | 3 | GTD-111/Pt-Al-Diffusion/EBPVD |

APS = Air Plasma Spray
EBPVD = electron beam physical vapor deposition

Limited areas of the specimens were damaged to simulate spallation. The specimens were damaged by hand with the assistance of a grinding wheel and a dremel tool. Care was taken to remove only the TBC, and each specimen was inspected optically to insure that the bond coat had not been breached. All specimens were damaged in the same manner to practically the same extent. After damage was complete, the specimens were cleaned and dried in preparation for repair.

To sols made from zirconium butoxide and yttrium methoxyethoxide, appropriate amounts of $H_2O$/acetic acid mixture were added to achieve hydrolysis and condensation of the sols. Complete gelation was avoided by controlling the pH, temperature and time. 10–15% (weight) of PSZ oxide was added to the solution to counter the anticipated shrinkage during the drying of the gel. These mixtures were poured with the help of a dropper into the damaged TBC areas of the specimens maintained at 160–170° C. The solvent quickly evaporated leaving the oxide precursor. After 3–4 additions the damaged area had the appropriate amount of TBC precursor. The amount of sol used to repair an approximately 5 mm diameter and 1 mm depth spallation typically is about 5 ml. The specimens were then fired at 900° C. under air for half an hour. The whole process was repeated to achieve a dense TBC material. If the surface of the TBC is not perfectly even after the repair is complete, then this could disrupt the air flow over the surface, so it is preferable to sand the repair to even the surface.

Following local spot repair, cyclic oxidation tests were conducted at 1065.5° C. (1950° F.) using a facility designed and fabricated by Southwest Research Institute (SwRI).

The set-up consists of a furnace, a force air cooling system, and a computer controlled moving arm that transfers the test specimens out of the furnace and into the air cooling system, and vice versa. The cycle used was 55 minutes at the elevated temperature followed by forced air cooling to room temperature for five minutes. Each test was run for 290 cycles. The purpose of the tests was to determine whether or not the locally repaired TBC would withstand thermal shock. A variety of specimens were subjected to thermal cycling, including: as-received, as-received plus damage (no repair), as-received plus damage with repair, and pre-oxidized plus damage with repair. All these specimens were visually examined and the condition of the repaired TBC was documented after 10, 30, 55, 120, 180, and 290 cycle exposures.

Figure 2:
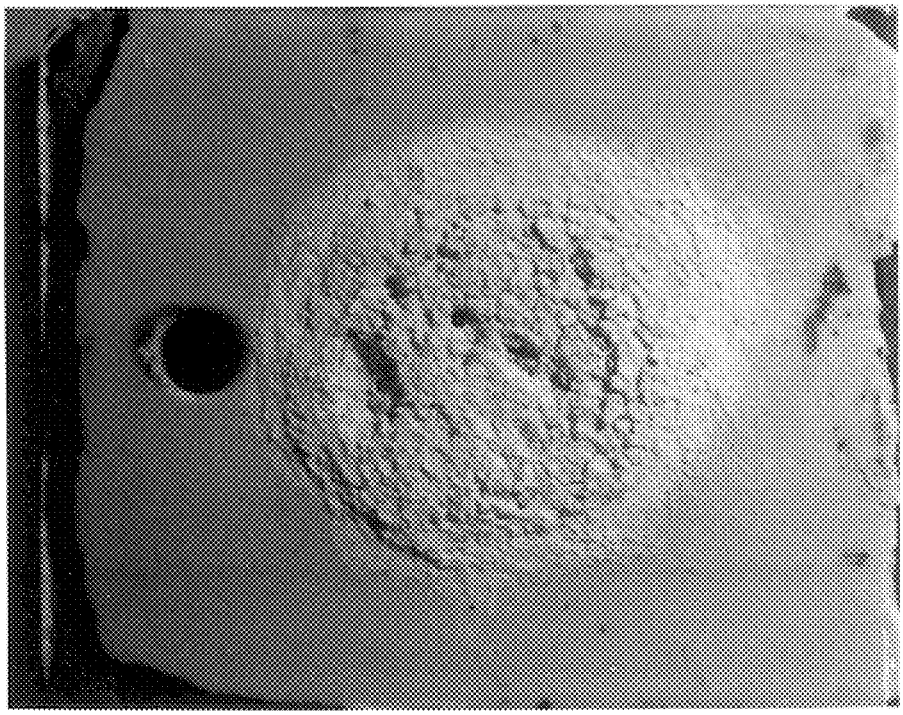
FIG. 2 shows a repaired specimen of GTD-111-EBPVD after 290 cycles of thermal oxidation.
Figure 3:
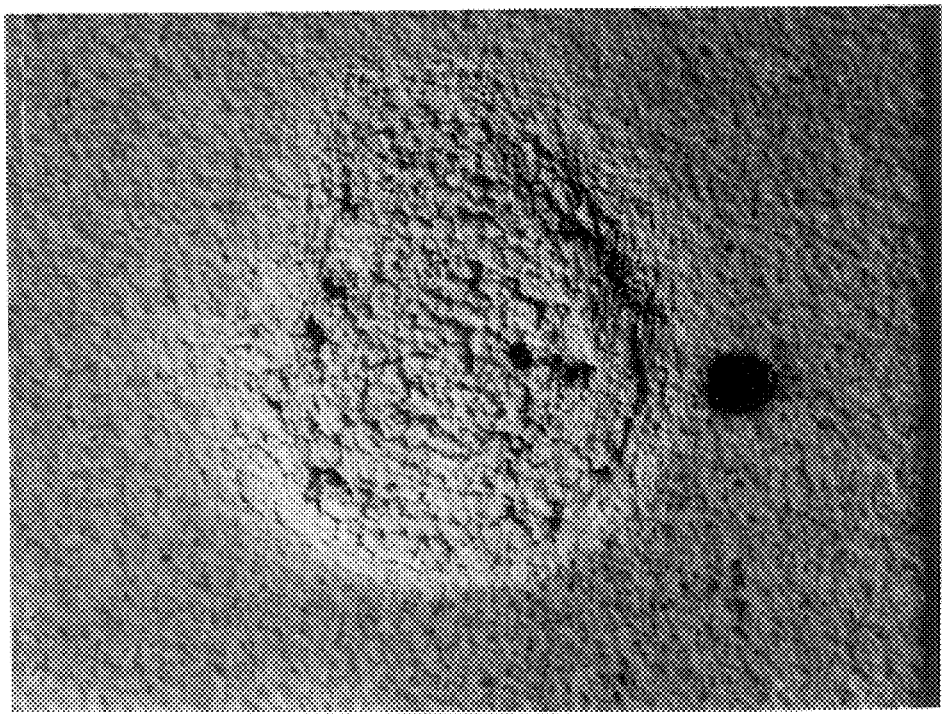
FIG. 3 shows a repaired specimen of IN 718-APS after 290 cycles of thermal oxidation.

The PSZ repair material was in good condition on all specimens. The PSZ repair survived for 290 cycles without spallation. However, spallation of the original yttrium stabilized zirconia occurred on the edges of some of the specimens. FIGS. 2 and 3 are photographs showing the condition of the PSZ repair after 290 cycles of thermal oxidation for GTD-111-EBPVD and IN 718-APS coated specimens, respectively.

Figure 4:
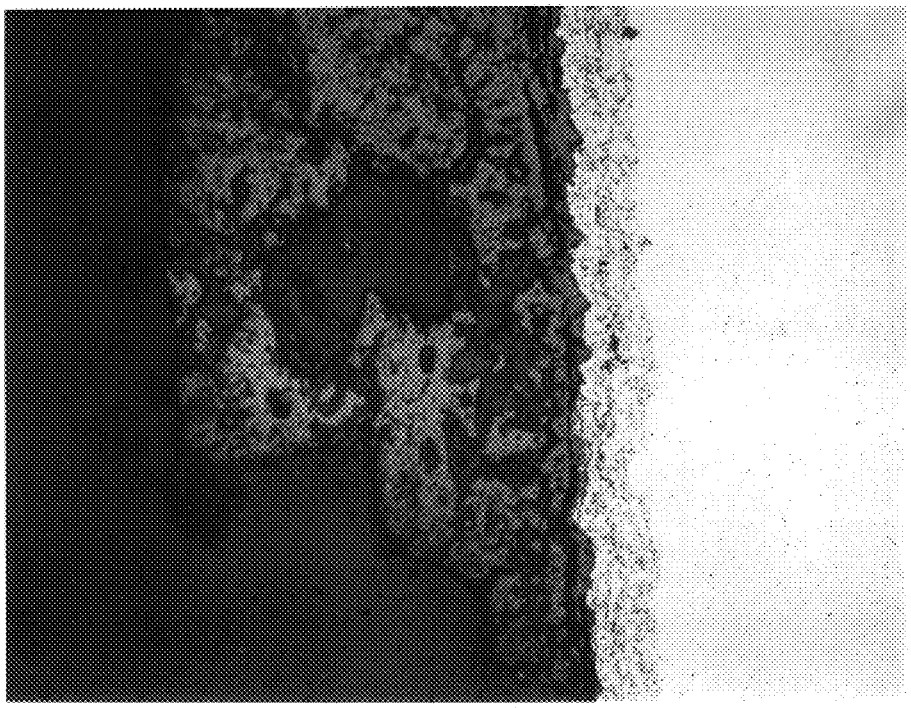
FIG. 4 is a microsection taken through the repair area of an HIT coated IN 718 specimen.
Figure 5:
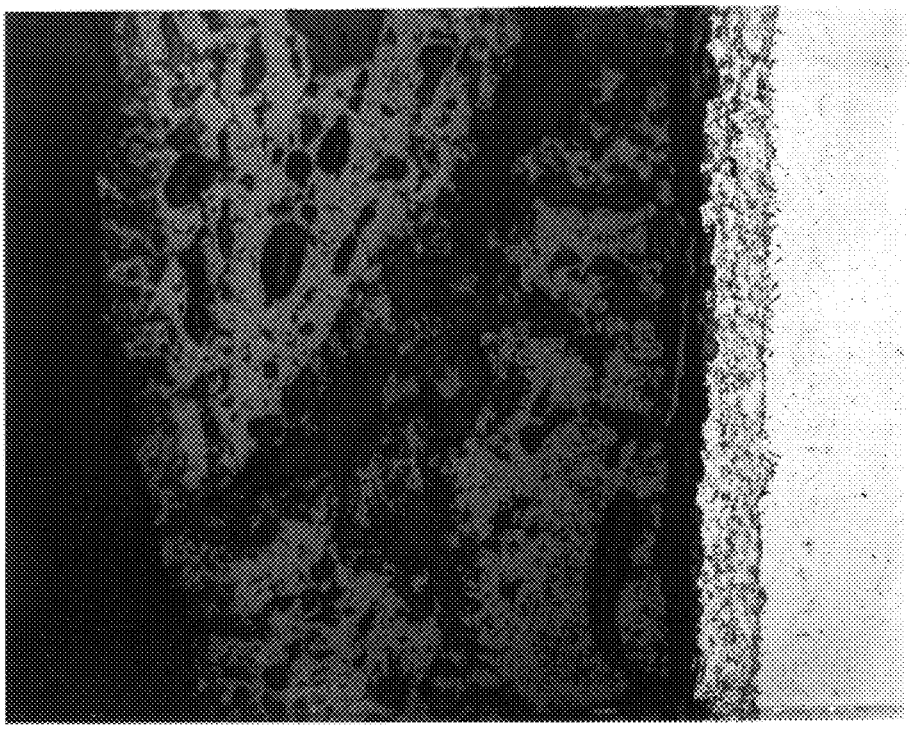
FIG. 5 is a microsection taken through the repair area of an HIT coated IN 738 specimen.
Figure 6:
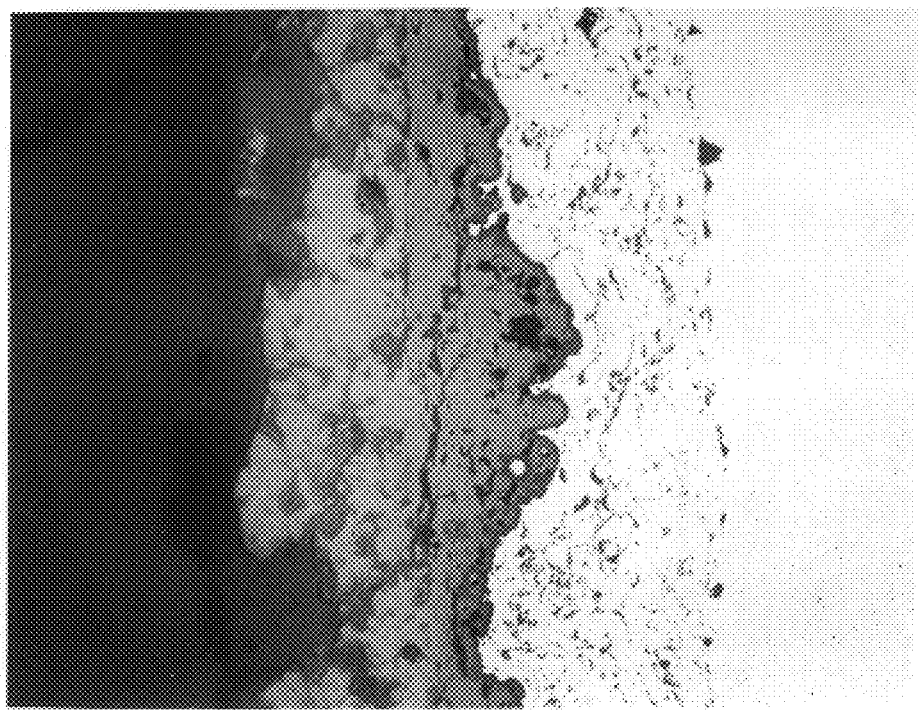
FIG. 6 is a microsection taken through the repair area of a Sermatech coated IN 718 specimen.
Figure 7:
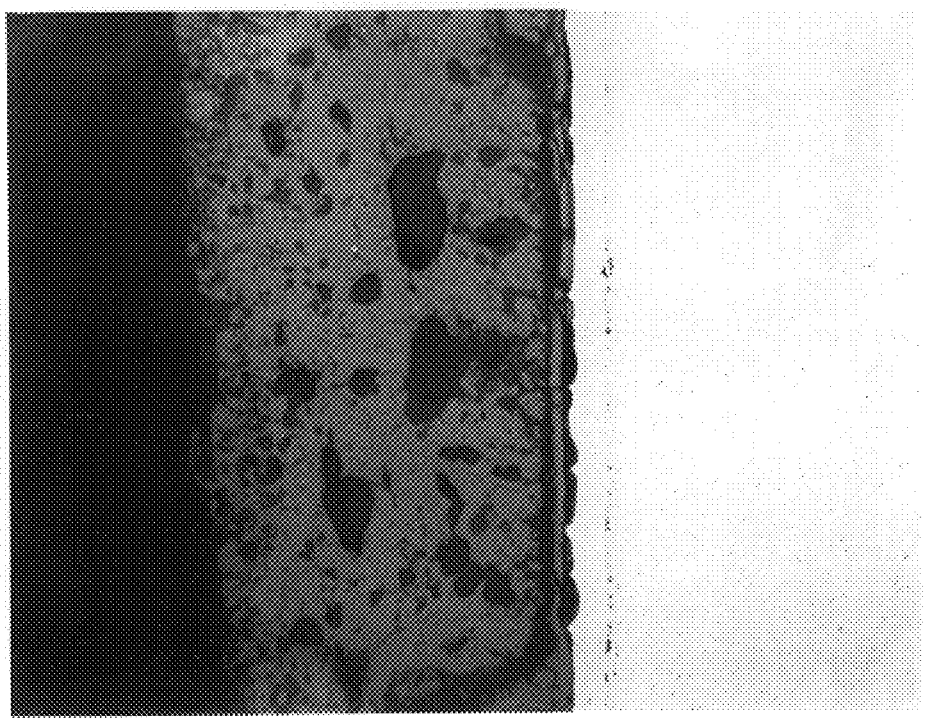
FIG. 7 is a microsection taken through the repair area of a Howmet coated GTD-111 specimen.

To examine the microstructure of the PSZ repair, a microsection was taken through the repair regions after 290 cycles of thermal exposure. FIG. 4 shows the microstructure of a repaired TBC on a HIT coated IN 718 specimens. FIG. 5 shows the microstructure of a repaired TBC on a HIT coated IN 738 specimen. FIG. 6 shows the microstructure of a repaired TBC Sermatech coated IN 718 specimen. FIG. 7 shows the microstructure of a repaired TBC Howmet coated GTD-111 specimen. In some areas, the repaired PSZ exhibited porosity, but no evidence of coating cracking was observed. The repaired PSZ was adherent to the various bond coats considered in this investigation and to any original TBC left over in the damaged regions. These results teach that PSZ sol-gels can be used for a simple, reliable spot repair of TBC coated turbine components.

The foregoing descriptions of specific embodiments of the present invention are presented for purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. The method of repairing a damaged area of a thermal barrier coating (TBC) applied to a metallic bond layer on a component comprising the steps of:

cleaning the damaged area to expose the metallic bond layer, directly applying a partially stabilized zirconium (PSZ) sol-gel material to said damaged area, allowing said sol-gel PSZ material to dry, and pyrolizing said dried sol-gel layer to form a reiair thermal barrier coating at said damaged area.

2. The method of claim 1 wherein said steps of applying the partially stabilized zirconia sol-gel, allowing the sol-gel to dry and pyrolizing the dried sol-gel layer, are repeated until a repair TBC coating of desired thickness is formed.

3. The method of claim 1 in which the metallic layer is MCrAlY where M is iron, cobalt and/or nickel.

4. The method of claim 1 in which the metallic layer is PAL.

5. The method as in claim 3 or 4 wherein the metallic layer is deposited by plasma spray.

6. The method as in claim 1 wherein the TBC coating is applied by plasma spray, and in which the metallic layer is MCrAlY where M is iron, cobalt and/or nickel.

7. The method as in claim 1 wherein the TBC coating is applied by plasma spray and in which the metallic layer is PtAl.

8. The method as in claim 1 wherein the TBC coating is applied by electron beam physical vapor deposition.

9. The method of claims 1 in which the repair thermal barrier coating is manually applied.

10. The method of repairing a damaged area of a thermal barrier coating applied to a metallic bond layer on a component comprising the steps of:

cleaning the damaged area to expose the metallic bond layer, directly applying a partially stabilized zirconium (PSZ) sol-gel material to said damaged area, and pyrolizing said sol-gel layer to form a repair thermal barrier coating at said damaged area.

11. The method of claim 10 wherein said repair thermal barrier coating is PSZ.

12. The method of claim 10 wherein said steps of applying the partially stabilized sol-gel, allowing the sol-gel to dry and pyrolizing the sol-gel layer, are repeated until a repair thermal barrier coating of desired thickness is formed.

13. The method of claim 10 in which the metallic layer is MCrALY where M is iron, cobalt and/or nickel.

14. The method of claim 10 in which the metallic layer is PtAl.

15. The method as in claims 13 or 14 wherein the metallic layer is deposited by plasma spray.

16. The method of claim 10 or 11 in which the thermal barrier coating is applied manually.

* * * * *